United States Patent [19]

Volz

[11] 4,356,360

[45] Oct. 26, 1982

[54] PULL-TO-TURN SWITCH

[75] Inventor: Jack H. Volz, Maplewood, N.J.

[73] Assignee: AMF Incorporated, White Plains, N.Y.

[21] Appl. No.: 238,304

[22] Filed: Feb. 26, 1981

[51] Int. Cl.[3] ..... H01H 21/00

[52] U.S. Cl. ..... 200/11 R; 200/11 J; 200/291

[58] Field of Search ..... 200/4, 11 R, 11 A, 11 E, 200/11 EA, 11 G, 11 H, 11 J, 11 K, 14, 17 R, 156, 290, 291, 327

[56] References Cited

U.S. PATENT DOCUMENTS

| | | | |
|---|---|---|---|
| 2,980,770 | 4/1961 | Nabstedt | 200/291 X |
| 3,229,051 | 1/1966 | Hauser et al. | 200/11 A |
| 3,261,930 | 7/1966 | Sorenson | 200/11 G |
| 3,293,382 | 12/1966 | Lewandowski et al. | 200/291 X |
| 3,803,370 | 4/1974 | Garcia | 200/11 J |

*Primary Examiner*—James R. Scott

*Attorney, Agent, or Firm*—David E. Dougherty; Charles J. Worth

[57] ABSTRACT

A pull-to-turn rotary switch having an outer sleeve shaped housing into which a sleeve adapter is inserted and aligned by means of mutual detents. The sleeve adapter is provided with a washer shaped bottom plate which divides the housing into two chambers, one of which contains a biasing spring and a dual stop means and the other contains the switch contacts and a contact plate or rotor driven by the innermost end of the actuating shaft to which it is slidably keyed. The dual stop means includes two separate and distinct detent discs each cooperating with a separate and distinct detent stop pin or pins.

14 Claims, 19 Drawing Figures

PULL-TO-TURN SWITCH

The present invention relates to switches, and, more particularly, to a single or multi-pole, multi-position pull-to-turn switch.

It has long been desirable in all multiposition rotary motion switches to have a positive position indexing and a multi-position stop feature to provide for a momentary safety halt prior to switching. Such position indexing and stop features have been accomplished in the prior art predominately by the utilization of detent mechanisms such as those described in U.S. Pat. Nos. 3,803,370 issued Apr. 9, 1974 to Ricardo L. Garcia; 3,965,755 issued June 29, 1976 to Rosenberg et al; 2,231,598 issued Feb. 11, 1941 to Shroyer and 2,642,502 issued June 16, 1953 to Johnson. It can be seen that such structures are quite complex and such complexity necessarily increases the cost of manufacturing. And, as a result of the complexity and sumptuous parts involved, the reliability of operation necessarily decreases.

Other prior art patents of interest include U.S. Pat. Nos. 2,980,770 issued Apr. 18, 1961 to Nabstedt; 3,560,672 issued Feb. 2, 1971 to Ludlum; 3,394,236 issued July 23, 1968 to Grundig et al; 3,402,268 issued Sept. 19, 1968 to Schink and 3,300,594 issued Jan. 24, 1967 to Paine et al. These prior art patents are merely typical of the art showing switches and are not intended to be an all inclusive list of pertinent references.

In contrast to the prior art, the present invention provides an improved switch assembly which is adapted for ease of use, involves a minimum of associated parts, simplifies the assembly process, provides reliability of operation at reduced manufacturing costs, and utilizes a dual stop arrangement.

SUMMARY OF THE INVENTION

The present invention relates to a pull-to-turn switch assembly which comprises an outer sleeve shaped housing into which a sleeve adapter is inserted and aligned by means of mutual detents. The pull-to-turn sleeve adapter has a washer shaped bottom plate which divides the housing into two chambers, with the switch shaft passing through the opening in the bottom plate. One of the chambers contains a dual stop arrangement which includes a stop collar and a stop washer each keyed to the switch shaft for rotational movement therewith and a helical spring interposed therebetween. Both the stop collar and the stop washer have a tab which cooperates with separate and distinct stop pins to define the rotational movement of the shaft. The other chamber contains a rotor having a bridging contact.

Accordingly, it is an object of the present invention to provide a pull-to-turn switch.

It is another object of the invention to provide an improved pull-to-turn switch assembly which has relatively few parts and simplifies the assembly process.

It is a further object of the invention to provide a rotary multi-position switch which has its rotational motion defined by the cooperation of two separate stop discs each with relatively short abutment means mounted thereto.

It is still a further object of the present invention to provide an improved pull-to-turn sleeve adapter which is positionally held within the switch housing by means of mutual detents.

Another object of the invention is to provide a sleeve having wall means for compartmentalizing the switch for ease of assembly.

Another object of the invention is to provide a stop arrangement and/or construction for improved strength and reliability.

Another object of the invention is to provide a pull-to-turn dual stop arrangement.

BRIEF DESCRIPTION OF THE DRAWINGS

These and other objects and features of the present invention will be more apparent from the description of the preferred embodiment of the invention, taken in conjunction with the accompanying drawings, in which.

DETAILED DESCRIPTION OF THE INVENTION

Figure 1:
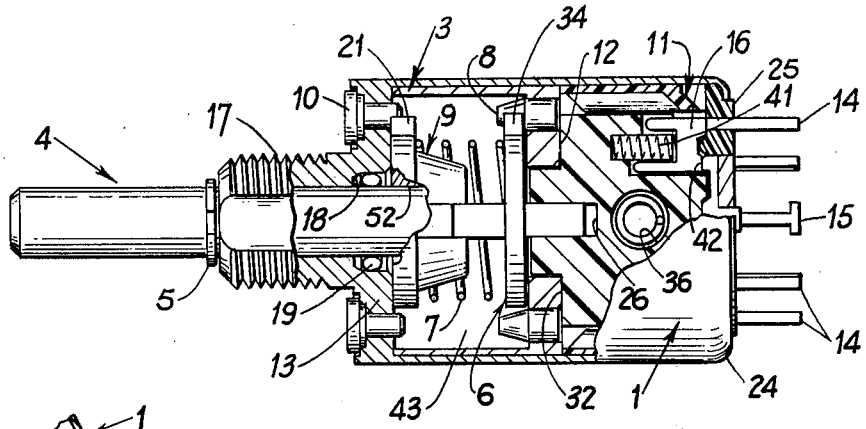
FIG. 1 is a cross sectional view of a pull-to-turn switch in one of a plurality of switch positions in accordance with the invention.
Figure 2:
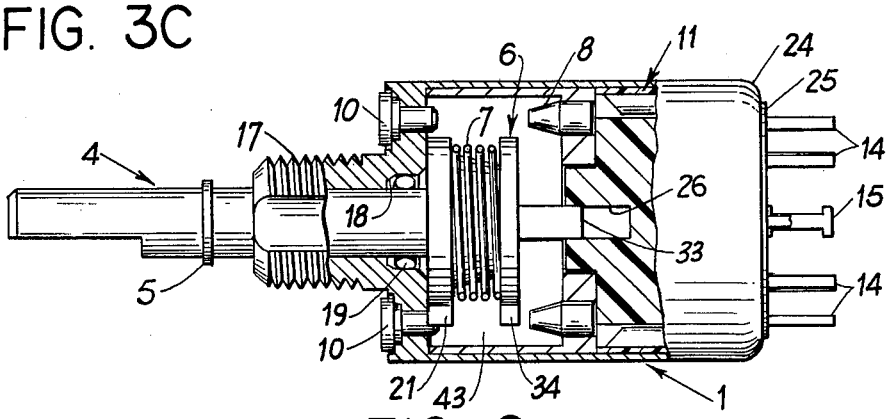
FIG. 2 is a cross sectional view of the switch of FIG. 1 with its switch shaft pulled outward to disengage the stop washer from the stop pin.

Referring to the drawings, particularly FIGS. 1 and 2, the preferred embodiment of the invention comprises a pull-to-turn switch having a housing 1, a rotor assembly 2, a pull-to-turn sleeve adapter 3, a shaft 4, a retaining ring 5, a stop washer 6, a pull-to-turn helical spring 7, a first stop pin(s) 8 mounted to the bottom plate 12 of the sleeve adapter 3, a stop collar 9, a second stop pin(s) 10 mounted to the end wall 13 of the housing 1, a detent sleeve 11, a plurality of terminals 14 all extending from one end of the switch with each corresponding to one position of the switch, and a center terminal 15 which may be selectively connected to any one of the terminals 14 by the bridging contact 16. It is pointed out that other terminal and contact arrangements can be provided by use of the switch structure to be described.

One end 13 of the housing 1 has a threaded tubular extention or bushing 17 outwardly extending therefrom for mounting the switch on a panel (not shown). The tubular extention 17 may have flat surfaces for cooperating with flat surfaces of the mounting hole in the panel for preventing rotation of the housing 1 with rotation of the shaft 4 during a turning action of the shaft 4. The inner opening of the tubular extention 17 contains a recessed portion 18 for receiving an "O" ring 19 therein which provides a gasket function between the shaft 4 and the housing 1.

Figure 3C:
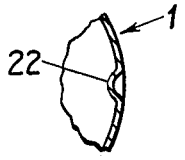
FIG. 3C is a partially cutaway end view of FIG. 3A showing the inward detent extention of the housing walls.
Figure 3B:
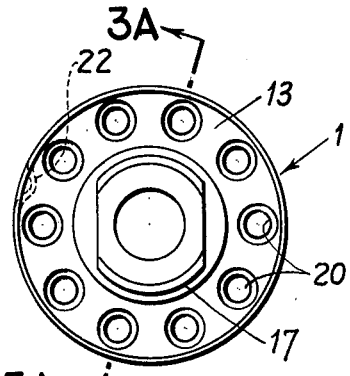
FIG. 3B is an end view showing the stop pin locating holes in the housing shown in FIG. 3A.
Figure 3A:
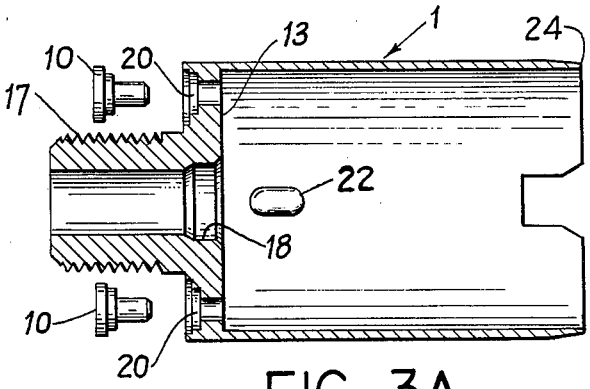
FIG. 3A is a cross sectional view taken along line 3A—3A of FIG. 3B.
Figure 4B:
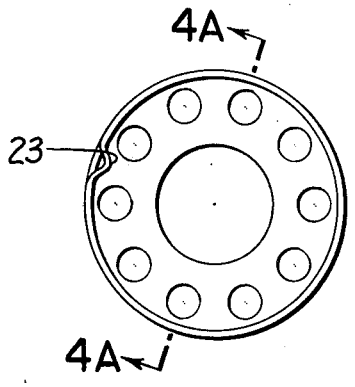
FIG. 4B is an end view of the sleeve adapter of FIG. 4.
Figure 4:
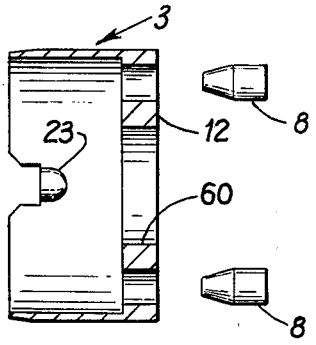
FIG. 4 is a sectional view taken along line 4A—4A of FIG. 4B.

A plurality of holes 20 (FIG. 3B) may be provided at regular angular positions in the end wall 13 of the housing 1. Stop pins 10 may be selectively positioned in the holes and extend to the interior of the housing for cooperating with a tab 21 on the stop collar 9 to restrict rotation of the shaft 4 through a desired arc. The interior wall of the housing 1 has an inwardly directed detent 22 (FIGS. 3A and 3C) which cooperates with a detent 23 (FIG. 4B) formed in the sleeve adapter 3 for holding the housing 1 and sleeve adapter 3 in fixed position relative to each other. The other end 24 of the housing 1 is open to permit insertion of the switch components during assembly and is rolled over or crimped on an end plate 25 made of insulating material such as plastic. Contacts 14 and 15 are affixed in the end plate 25 and have contact portions on the interior and exterior areas of the housing 1.

Figure 6A:
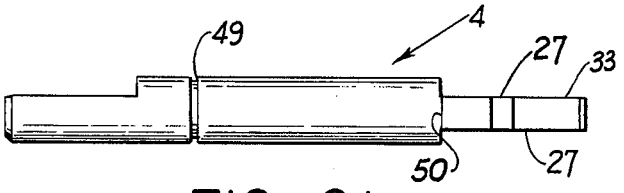
FIGS. 6A and 6B are side views of the shaft shown in FIG. 1.
Figure 6C:
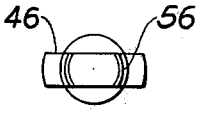
FIG. 6C is an end view of the shaft shown in FIG. 6A.
Figure 6B:
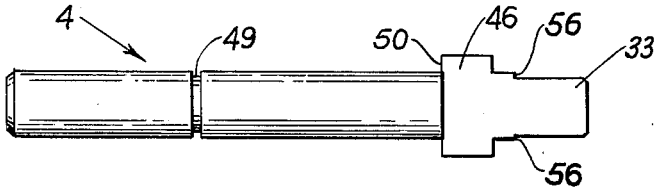

With reference to FIGS. 1, 2, 9A and 9B, it can be seen that the rotor includes a keyway or recess 26 having flat sides for accommodating the flat surfaces 27 (FIG. 6A) of the switch shaft 4. The rotor 2 is rotatably mounted within the housing 1 and is positionally held between the bottom plate 12 of sleeve adapter 3 and the end plate 25.

Figure 7A:
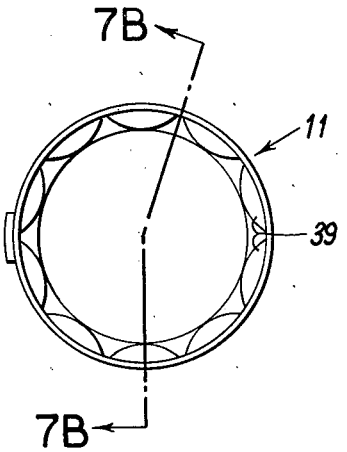
FIG. 7A is an end view of a detent sleeve.
Figure 7B:
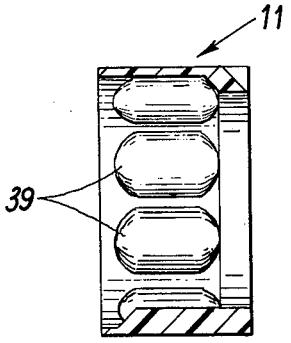
FIG. 7B is a view taken on line 7B—7B of FIG. 7A.
Figure 8:
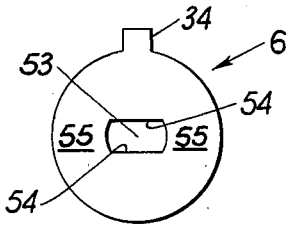
FIG. 8 is a top view of the stop washer in accordance with the invention.
Figure 9B:
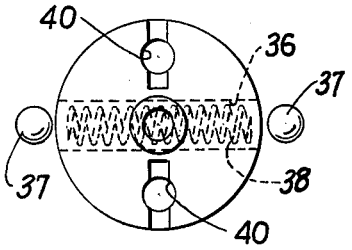
FIGS. 9A, 9B and 9C are views of the rotor shown in FIG. 1
Figure 9A:
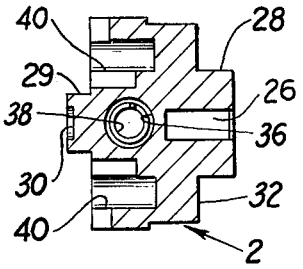
Figure 9C:
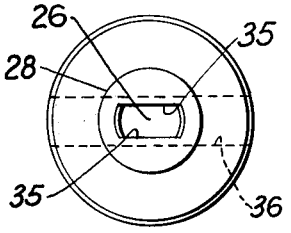

The rotor 2 contains a neck portion 28 which is rotatably received in the opening of the bottom plate 12. The other end 29 of the rotor 2 has a recess 30 for accommodating a button shaped portion 31 of the center contact 15 about which the rotor 2 is free to rotate. A shoulder portion 32 of the rotor 2 abuts with the bottom plate 12 of the sleeve adapter 3. The flat sided or tab end 32 of the shaft 4 is slidably received in the rotor keyway 26 and is longitudinally movable therein to permit the shaft to be axially disposed such that the stop washer 6 either contacts the bottom plate 12 (FIG. 1) or is outwardly pulled to disengage tab 34 of stop washer 6 from stop pin 8 (FIG. 2). The flat (key) sides 27 of the shaft 4 engage the flat sides 35 (FIG. 9C) of keyway 26 of the rotor 2 to cause rotational movement of the rotor 4 with rotation of the shaft when in the pulled-out position (FIG. 2). The rotor 2 has a detent section with a hole 36 extending through a diameter thereof into which balls 37 are positioned, with a helical spring 38 extending therebetween to bias the balls outwardly in opposite directions. The balls engage a ribbed section 39 on the inside surface of the detent sleeve 11 (FIGS. 7A and 7B) to provide a detent action in each of, for example, ten rotational tactile positions.

The rotor 2 also contains one or more openings 40 at an end thereof opposite the neck portion 28 for accommodating a bridging contact 16. Each bridging contact 16 is separately biased downwardly by a helical spring 41 to interconnect an extension or disc portion 42 of the center or common terminal 15, mounted in the insulating end plate 25, selectively with at least one of the switch position terminals 14.

A first or inner chamber 43 of the housing 1 (defined between the wall ends 12, 13 of the sleeve and housing 1, respectively) contains a dual stop arrangement comprising a stop collar 9 having a tab extention 21 which cooperates with one or more cantilevered stop pins 10 to define the arc through which the shaft 4 can be rotated, and a stop washer 6 having a tab extention 34 which cooperates with one or more cantilevered stop pins 8 to provide a momentary safety halt prior to switching, i.e., by requiring a pull-to-turn operation. Stop pin(s) 10 may be fixed in position during manufacture or a plurality of holes 20 may be provided to enable the user to select one or more of a plurality of stop pin(s) 10 positions. One or more stop pins 8 are fixed in position on the bottom plate 12 of the sleeve adapter 3 during manufacture. Each of the stop pins 8 and 10 are relatively short in length. Also the dual stop arrangement may provide stop (arc) flexibility by means of the combinational dual disc/stop pin feature.

Figure 5C:
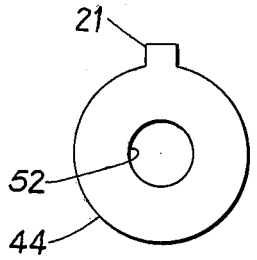
FIGS. 5B and 5C are end views of the stop collar shown in FIG. 5A.
Figure 5A:
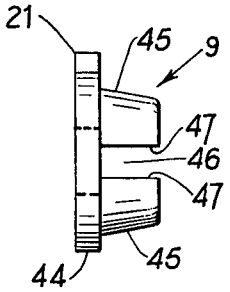
FIG. 5A is a side view of the stop collar shown in FIG. 1.

The stop collar 9 (FIGS. 5A and 5B) has a washer shaped base plate 44 having a tab extention 21 and two semi-circular ledge projections 45 which have flat sides 47 forming a keyway for slidably receiving the wide flat sided key portion 46 of the shaft 4. The flat sides 47 of stop collar 9 are engaged by the double flat key portion 46 of shaft 4 for causing coincidental rotation of the stop collar 9 when the shaft is in an outward pulled position and rotated. The ledge projections 45 are tapered, for example, at a 10 degree angle away from the base plate 44, for receiving thereabout a helical spring 7. The helical spring 7 is biased between the base plate 44 and the stop washer 6 thereby urging the stop collar 9 against wall 13 of the housing 1 and the stop washer against the bottom plate or wall end 12 of sleeve adapter 3.

Figure 5B:
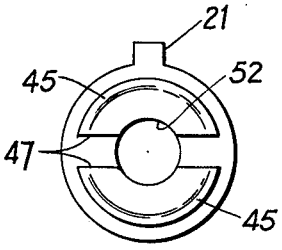

The shaft 4 is mounted in the opening in the tubular extention 17 for axial and rotational movement and has a key end portion 33 which is inserted within the opening 60 in the sleeve 3 for being slidably received in the keyway 26 of the rotor 2. The shaft 4 contains an annular groove 49 for receiving a retaining ring or C-clip 5 therein. A shoulder portion 50 of the shaft 4 abuts against the wall portion 51 of the circular opening 52 in the base plate 44 of the stop collar 9 (FIG. 5B).

The stop washer 6 is affixed to an inner portion of the key end 33 of the shaft by any conventional means such as by staking or welding. By pulling the shaft 4 in an outward direction, the helical spring 7 is compressed between the stop collar 9 and the stop washer 6 to enable tab 34 to be rotated past stop pin 8. The stop washer 6 has an opening 53 dimensioned to fit on the shaft end portion 33 and having flat sides 54 which mate with the flat sides 27 of the shaft 4 for being caused to rotate therewith. The side walls 55 of the stop washer 6 abut against a shoulder portion 56 of the shaft 4 to position the stop washer 6 on the shaft 4 so as to enable tab 34 to abut stop pin 8 with the stop washer 6 being biased against or adjacent the bottom plate 12.

While a certain specific preferred embodiment has been set forth for the invention for the sake of illustration to persons skilled in the art, it is not intended to be limitative. For example, it should be recognized that the stop pins 8 and 10 may be formed as integral projecting abutment portions of the stop washer 6 and the stop collar 9, respectively.

I claim:

1. A pull-to-turn electrical switch including in combination:

a case having a first open end and a second wall end with an opening for access to the interior of the case;

a first stop pin means projecting inwardly from the second wall end of said case;

a shaft mounted in said opening of the case for axial and rotational movement, having an interior end portion, and having an actuating end portion without the case;

stop collar means keyed to the shaft for rotation therewith and having a tab extention for abutting with said first stop pin means for defining the rotatable arc of the shaft;

a second plurality of stop pins disposed within the interior of the case;

stop washer means affixed to an intermediate portion of the shaft for axial and rotational movement therewith and having a tab projecting from a peripheral portion for abutting with one or more of said second plurality of stop pins for restricting rotation of the shaft while in a first axial position and not restricting rotation of the shaft while in a second axial position;

a rotor rotatably positioned within the case having means engaging the interior end portion of the shaft to effect rotation of the rotor therewith, and having at least one bridging contact movable with the rotor and positioned at an end thereof opposite to said engaging means; and an end plate having at least two contact means secured thereto and adapted to be engaged by the bridging contact in a rotational position of the shaft, said end plate being secured to the first open end of the case.

2. A switch as in claim 1, wherein:

the stop collar comprises a washer shaped plate having the tab extention at a peripheral portion thereof, and having a central opening, said washer shaped plate includes two sidewardly projecting ledge portions having flat portions forming a keyway; and the shaft is slidably inserted in the central opening of the stop collar and contains flat portions forming a key for engaging said keyway to cause rotation of the stop collar with rotation of the shaft.

3. A switch as in claim 2, wherein:

the second wall end contains a plurality of holes positioned about the opening in the case, and having one or more stop pins each separately mounted in one of said holes, said stop pins having an end portion extending within the interior of said case and adapted for being engaged by the tab extention of the stop collar.

4. A switch as in claim 3, including:

a helical spring positioned about the shaft between the stop collar and the stop washer and dimensioned to bias the stop collar and the stop washer in opposite directions so that with the shaft being disposed toward said second axial position the helical spring is compressed therebetween.

5. A switch as in claim 4, including:

a plurality of bridging contacts each movable with the rotor for electrically interconnecting the center contact with two of the separate contacts disposed thereabouts.

6. A switch as in claim 1, including:

a support structure shell configured to fit within said case, and having a first open end portion adjacent said second wall end of the case, and having an end wall with a central opening therein coaxial with the opening in the case, said second plurality of stop pins projecting from the end wall of said support structure and being spaced about said central opening each adapted for abutting with the tab of the stop washer in a selected switch position, said end wall of the shell defining a first and a second chamber so that the first means defining the rotatable arc and the second means restricting/not restricting rotation of the shaft are within the first chamber and the rotor is within the second chamber having said engaging means adjacent the central opening of the shell for being engaged by the interior end portion of the shaft.

7. A switch as in claim 6, wherein:

the end plate includes a center contact adapted for being in contact with a first portion of the bridging contact, and having a plurality of separate contacts disposed about the center contact each for being separately contacted by a second portion of the bridging contact with the rotor in a selected tactile position.

8. A switch as in claim 1, including:

a detent means comprising a spring biased ball mounted in said rotor for cooperating with a ribbed sleeve positioned about said rotor for providing a plurality of predetermined tactile positions for the rotor.

9. A switch assembly in combination comprising:

a cylindrical housing having a first open end and a second wall end, said wall end having a generally center hole therein for access to the interior of the housing and a plurality of holes spaced about the center hole;

a cylindrical sleeve disposed within the housing having a first open end portion juxtaposed with the interior wall of the housing second wall end, and having an end wall with a central opening therein coaxial with the center hole of the housing and a plurality of holes spaced about the central opening, said end wall of the sleeve defining a first and a second chamber within the housing;

a first plurality of stop rods each mounted within one of the holes about the center hole in the housing and having an interior end portion projecting within the first chamber;

a second plurality of stop rods each mounted within one of the holes about the central opening in the sleeve and having an end portion projecting within the first chamber;

a shaft mounted in the center hole of the housing for axial and rotational movement, and having an intermediate section having a flat portion within the first chamber and an end portion extending within the central opening in the sleeve, and having an actuating end portion without the housing;

a stop collar slidably disposed about the intermediate section of the shaft, and having a flat portion engaged by the intermediate flat portion of the shaft for effecting coincident rotation therewith, and having a projecting portion for engaging the first plurality of stop rods with rotation of the stop collar through a predetermined arc;

a stop washer affixed to a portion of the intermediate section of the shaft, and having a tab projecting portion interposed between two of said second plurality of stop rods in a first axial position of the shaft and disposed from between said two stop rods with said shaft being disposed to a second axial position;

biasing means for urging the shaft into said first axial position, said shaft being pulled outwardly longitudinally against the bias of the biasing means to dispose said shaft in the second axial position;

a cylindrical rotor rotatably positioned within the second chamber and having a keyway for slidably receiving the end portion of the shaft and adapted to engage said end portion to effect coincident rotation therewith, and having a bridging contact movable with the rotor and positioned at an end thereof opposite to the keyway;

an end plate having at least two contact means secured thereto and adapted to be selectively interconnected by the bridging contact.

10. A switch as in claim 9, wherein:

the biasing means comprises a helical spring spaced about the intermediate section of the shaft and having a first end portion biased against the stop collar and a second end portion biased against the stop washer.

11. A switch as in claim 10, including:

mutual detent means disposed between the cylindrical walls of the housing and the sleeve to hold same in fixed relative rotational position.

12. A switch as in claim 10, including:

a gasket means for substantially preventing migration of contaminants between the shaft and the center hole of the housing to within the interior of the housing.

13. A multi-position pull-to-turn rotary switch in combination comprising:

a cylindrical housing having a first open end and a second wall end with a central opening, and having a plurality of holes in said second wall end positioned about the central opening, and having an inwardly directed detent portion projecting from a portion of the cylindrical wall of the housing;

a cylindrical sleeve of slightly smaller diameter than said housing and of approximately half the length of said housing coaxially positioned within the housing, and having a first open end portion adjacent the second wall end of the housing, and having a second wall end with a center opening and a plurality of holes positioned thereabouts, said second wall end of the sleeve being in substantially spaced parallel relation with the second wall end of the housing, the cylindrical wall of the sleeve having an inwardly directed detent portion adapted to receive the housing detent therein;

a first plurality of stop pins each mounted in one of the holes in the sleeve and having a cantilevered end portion between the second wall ends of the housing and the sleeve;

a second plurality of stop pins each mounted in one of the holes in the housing and having a cantilevered end portion between the second wall ends of the housing and the sleeve;

a stop collar having a washer shape and on one side thereof being adjacent the second wall end of the housing with ledge portions extending sidewardly from the other side thereof, and having an abutment means for engaging one or more of the first plurality of stop pins with said stop collar being rotated through a predetermined arc;

a stop washer in spaced parallel relation with the stop washer within the interior of the sleeve, and having an abutment means for selectively engaging one or more of the second plurality of stop pins to constrain rotational movement of the stop washer;

a shaft mounted in the central opening in the housing for axial and rotational movement, and having a first intermediate portion coupled to the stop collar to cause coincident rotation thereof, and having a second intermediate portion coupled to the stop washer to cause coincident axial and rotational movement thereof, and having an interior end portion contiguous with the center opening in the sleeve, and having an actuating end portion without the housing;

a helical spring having a first end about the ledge portions of the stop collar and a second end abuting with the stop washer and adapted to bias said stop collar and stop washer in relative outwardly opposing directions;

a cylindrical rotor rotatably positioned within said housing without said sleeve interior and having a first end comprising a shoulder portion adjacent the outer surface of the second wall end of the sleeve with an axle portion projecting within the center opening of the sleeve and coupled to the interior end portion of the shaft to effect coincident rotational movement, and having a bridging contact movable with the rotor and positioned at an end thereof opposite said first end of the rotor;

a detent means coupled to said rotor to provide predetermined tactile positions for said rotor within said housing; and an end plate secured to the first open end of the housing having a center contact with a plurality of separate contacts positioned thereabouts and adapted so that the bridging contact interconnects the center contact with a different one of the separate contacts in each of the tactile positions of the rotor.

14. A switch as in claim 13 wherein:

the stop collar includes two ledge portions diametrically spaced apart on either side of the shaft; and the helical spring is disposed about the shaft with the first end of the helical spring being mounted over said two ledge portions.

* * * * *